US012648586B2

(12) United States Patent
Wang et al.

(10) Patent No.: US 12,648,586 B2
(45) Date of Patent: Jun. 9, 2026

(54) DEVICE AND METHOD FOR REDUCING COMBUSTION CONE FALLOUT PROPENSITY AND STABILIZING LOSS OF TOBACCO FROM CIGARETTE ENDS

(71) Applicant: Zhangjiakou Cigarette Factory Co., Ltd., Zhangjiakou (CN)

(72) Inventors: Zhen Wang, Zhangjiakou (CN); Peng Ji, Zhangjiakou (CN); Jianlong Zhang, Zhangjiakou (CN); Duanduan Li, Zhangjiakou (CN); Laihong Zhou, Zhangjiakou (CN); Zhaohui Ma, Zhangjiakou (CN); Jiansheng Yang, Zhangjiakou (CN); Xin Zhao, Zhangjiakou (CN); Huge Liu, Zhangjiakou (CN); Xiaojun Zhang, Zhangjiakou (CN); Yan Li, Zhangjiakou (CN); Xuena Song, Zhangjiakou (CN)

(73) Assignee: Zhangjiakou Cigarette Factory Co., Ltd., Zhangjiakou (CN)

( * ) Notice: Subject to any disclaimer, the term of this patent is extended or adjusted under 35 U.S.C. 154(b) by 572 days.

(21) Appl. No.: 18/218,140

(22) Filed: Jul. 5, 2023

(65) Prior Publication Data

US 2024/0008521 A1 Jan. 11, 2024

(30) Foreign Application Priority Data

Jul. 5, 2022 (CN) ..... 202210790995.0

(51) Int. Cl.
*A24B 3/18* (2006.01)
*A24B 3/16* (2006.01)

(52) U.S. Cl.
CPC . *A24B 3/16* (2013.01); *A24B 3/18* (2013.01)

(58) Field of Classification Search
CPC .. A24B 1/04; A24C 5/396; B07B 1/28; B07B 1/286; B65G 69/12
See application file for complete search history.

(56) References Cited

U.S. PATENT DOCUMENTS 4,646,759 A * 3/1987 Thatcher ..... B03B 4/02 131/109.2
4,991,598 A * 2/1991 Henderson ..... A24B 5/00 131/290

(Continued)

FOREIGN PATENT DOCUMENTS

CN 207306052 U 5/2018

OTHER PUBLICATIONS

Writing Department, ZJ112 Type Winding Unit (Mechanical Part), Apr. 2017, Hennan Science and Technology Press.

*Primary Examiner* — Eric Yaary

(57) ABSTRACT

Disclosed is a device and method for reducing combustion cone fallout propensity and stabilizing loss of tobacco from ends. Firstly, the right installation positioning hole is moved rightwards to extend the distance of the separation zone. Meanwhile, the vibration mechanism is redesigned so that it is enabled to move toward the lower right of the material groove body. Therefore, there is enough space to install the separation screen in the separation zone. Finally, the separation screen is installed. The tobacco scraps are separated out when they pass through the separation screen, thus reducing cone dropping when the cigarette burns, stabilizing the amount of dropping tobacco at the end, and improving the smoking experience and recognition of customers with regard to cigarette products.

5 Claims, 8 Drawing Sheets

(56) References Cited

U.S. PATENT DOCUMENTS

| | | | | |
|---|---|---|---|---|
| 5,103,981 | A * | 4/1992 | Abbott | B07B 9/00<br>209/139.1 |
| 2015/0047657 | A1 * | 2/2015 | Wu | A24B 13/02<br>131/306 |

* cited by examiner

DEVICE AND METHOD FOR REDUCING COMBUSTION CONE FALLOUT PROPENSITY AND STABILIZING LOSS OF TOBACCO FROM CIGARETTE ENDS

CROSS REFERENCE TO RELATED APPLICATION

This application claims priority of Chinese Patent Application No. 202210790995.0 filed on Jul. 5, 2022 and entitled "device and method for reducing combustion cone fallout propensity and stabilizing loss of tobacco from cigarette ends", the contents of which are incorporated herein by reference in their entirety.

FIELD OF TECHNOLOGY

The present invention relates to the field of cigarette equipments, and in particular to a device and method for reducing combustion cone fallout propensity and stabilizing loss of tobacco from ends.

BACKGROUND TECHNOLOGY

A cigarette making and plug assembling machine (ZJ17 Type) can be divided into three parts of a feeding and sliver forming machine, a round baler and a filter tip assembling machine. The function of the feeding and sliver forming machine is to put tobacco delivered to a hopper into a tobacco storage area, and a lifting belt takes out the tobacco stored in the tobacco storage area. First, a tobacco roller is used for loose handling, and then a magnetic device removes iron impurities. Then, uniform, stable and continuous tobacco bundles are delivered for a tobacco suction molding system after the impurities such as stems are removed by a cut stem separation system. Before being fed to the round baler, the continuous tobacco bundles are trimmed to tobacco strips which meet the quality requirements of the process by a paddle device in a weight control system. The tobacco trimmed down by the paddle device is sent back to the tobacco storage area through an excess tobacco recycling system, waiting to be taken out again by the lifting belt and put into a tobacco supply system for recycling.

Refer to FIG. 1 and FIG. 2, an excess tobacco recycling system of a YJ17 feeding and sliver forming machine is mainly composed of a primary excess tobacco recycling device 20, a secondary excess tobacco recycling device 10, and an excess tobacco recycling material groove 30. A discharging end of the secondary excess tobacco recycling device is located above a feeding end of the primary excess tobacco recycling device, and a discharging end of the primary excess tobacco recycling device is located above a feeding end of the excess tobacco recycling material groove. The secondary excess tobacco recycling device, the primary excess tobacco recycling device and the excess tobacco recycling material groove are in a return shape conveying state. The primary and secondary excess tobacco recycling conveying belts transport the fallen tobacco after trimming to the excess tobacco recycling material groove. The excess tobacco recycling material groove is communicated with a material storage area. The excess tobacco recycling material groove conveys a certain proportion of tobacco trimmed down back to the material storage area at the back of the feeding and sliver forming machine after periodic vibration at a higher frequency. The certain proportion of tobacco trimmed down by the paddle device corresponds to the amount of recycled excess tobacco, and the amount of the recycled excess tobacco is proportional to the amount of fed tobacco. According to production technical requirements of ZJ17 cigarette making and plug assembling equipment, the amount of recycled excess tobacco is about 25%-35% of the amount of fed tobacco. Therefore, according to technical requirements of gram weights of a single cigarette required by different brands, the amounts of tobacco trimmed down by the paddle device from a tobacco suction channel are not exactly the same. At the same time, the larger the amount of fed tobacco, the larger the amount of tobacco trimmed down, and the larger the amount of recycled excess tobacco. When the amount of the recycled excess tobacco increases to a certain value, due to excessive dressing of tobacco, destruction of tobacco structure gradually plays a leading role, that is, it would cause a phenomenon of broken tobacco, which causes that a loose-end rate of cigarettes begins to rise. A main reason for this phenomenon is that the amount of broken tobacco in the feeding tobacco is greater than 2% and the broken tobacco generated after the paddle device trims the tobacco is filled into the tobacco bundles. When the broken tobacco is filled in an igniting end, it would cause that the tobacco at the igniting end can not be held firmly in the position and falls after shaking, resulting in that the amount of falling tobacco at the end is unqualified. When a certain amount of broken tobacco is filled into a middle part of the cigarette, a combustion cone of the cigarette would fall off or obvious skew in a process of burning and sucking or tapping cigarette ash, leading to a phenomenon of suction interruption, that is, the head of the combustion cone falls off, commonly known as cone dropping. In a batch of cigarette samples, a ratio between the number of cigarettes with combustion cone dropping and a total number of cigarettes tested is called cigarette combustion cone dropping in percentage. When the cigarettes tending to have combustion cone dropping reach a certain number, it is regarded as unqualified products. A calculation formula thereof is as follows:

$$CCFP=n/m\times100\%$$

In the formula, CCFP: a percentage of combustion cone fallout propensity (a percentage of tending to have combustion cone dropping), and the result is accurate to 1%;

n: the number of cigarettes in which burning cone drops (unit: branch):

m: the number of cigarettes tested (unit: branch).

Therefore, it is necessary to study a method that can remove fine crushed tobacco scrap that does not meet the process requirements from the broken tobacco. Through this innovative and improved method, a filling amount of broken tobacco in the cigarette can be reduced, the phenomenon of cone dropping can be reduced, and the loss of tobacco from cigarette ends (the amount of tobacco dropping at the end) can also be stabilized at the same time. In order to meet the process requirements of the product, a rate of whole tobacco filled into the tobacco bundles is kept in an optimal state to the maximum extent.

SUMMARY OF THE INVENTION

The present application provides a device and method for reducing combustion cone fallout propensity and stabilizing loss of tobacco from cigarette ends, which can make fine tobacco scraps that do not meet the requirements of a filling process be separated out during a process of excess tobacco recycling, and the tobacco in line with the requirements of the filling process be transmitted to a material storage area for the excess tobacco recycling.

A technical solution adopted by the present invention to solve the technical problems is as follows:

A device for reducing combustion cone fallout propensity and stabilizing loss of tobacco from cigarette ends, wherein the device comprises:

a material groove body of which a feeding end is higher than a discharging end, wherein a bottom surface of the material groove body is provided, from left to right, with a left installation positioning hole in a left end, a plurality of dropping tobacco holes, and a separation rectangular hole having an equal width to the material groove body and a right installation positioning hole; the right installation positioning hole is moved rightwards to a right end of the material groove body to extend a separation distance of tobacco scraps; and the material groove body comprises a guide positioning groove matched with the separation rectangular hole;

a separation screen detachably installed to fit the guide positioning groove, wherein the separation screen is used for separating the tobacco scraps; and a vibration mechanism, installed below the feeding end through the right installation positioning hole, wherein the vibration mechanism comprises a positioning block, an elastic vibration plate, and a power mechanism, wherein the power mechanism drives the positioning block to move, the positioning block drives the material groove body for uninterrupted reciprocating movement under the support of the elastic vibration plate; the positioning block is fixedly connected with the material groove body through the right installation positioning hole, an upper end of the elastic vibration plate is installed in a side surface of a lower part of the positioning block toward a side of the feeding end, a lower end of the elastic vibration plate is installed in an upper part of the power mechanism, so that the vibration mechanism shifts toward lower right, so as to provide a maximum installation space for the separation screen without affecting movement effect of the material groove body.

In an further solution, the guide positioning groove comprises a baffle plate and two positioning plates having a width equal to a width of the material groove body and arranged in parallel, the baffle plate and the two positioning plates are vertically arranged, a cross section of each positioning plate is in a convex shape, the guide positioning groove is embedded in the separation rectangular hole, an outer side of a raised platform of each positioning plate is fixed by fitting with the separation rectangular hole, an upper end surface of the raised platform is in the same plane as an inner bottom surface of the material groove body, a sinking platform inside each positioning plate is provided as a guide slide rail that is capable of being inserted into the separating screen, and the baffle plate is fixed by fitting with an outer side of the material groove body to limit a moving position of the separation screen.

In a further solution, the separation screen comprises a screen mesh, a fixed plate and a guide channel located below the screen mesh and used for a guide discharge function after tobacco scrap separation, two sides of the screen mesh are capable of being inserted in the guide slide rail of a positioning plate, and the fixed plate is fixed by fitting with an outer side of the material groove body.

In a further solution, the separation screen comprises a plurality of mesh distribution and mesh number specifications to select an appropriate separation screen for separating tobacco scraps according to tobacco structures of high, medium and low grade cigarettes.

In a further solution, the separation screen is provided with an inclined surface having an upper end surface facing a side of the discharging end or a wavy surface from top to bottom, so as to change a movement pattern for conveying recycled excess tobacco and to make broken tobacco located in an upper layer be fully separated by wave motion in vibration in the process of excess tobacco recycling.

In an further solution, the power mechanism comprises a motor, a transmission bracket, an eccentric disk and a connecting rod, wherein a lower end of the elastic vibration plate is installed in an upper part of the transmission bracket, so as to provide sufficient installation space for the separation screen to a maximum extent without affecting a movement effect of the material groove body; the transmission bracket is provided with a center hole for installing the motor, an output shaft of the motor is rotatably connected with the eccentric disk through a bearing; the eccentric disk is rotatably connected with a big head of the connecting rod; a small head of the connecting rod is connected with the positioning block; and when the motor rotates, the eccentric disk drives the connecting rod to move, the connecting rod drives the positioning block to move, and the positioning block drives the material groove body to make the uninterrupted reciprocating movement under the support of the elastic vibration plate.

In a further solution, the separation screen is replaced by a stem-taken box for exporting materials; the stem-taken box comprises a fixed plate and a guide channel communicated with the material groove body; and the fixed plate is fixed by fitting with an outer side of the material groove body.

Meanwhile, provided in the present application is a method for reducing combustion cone fallout propensity and stabilizing loss of tobacco from cigarette ends, with regarding to the tobacco recycling process, the present application improves an original excess tobacco recycling material groove. Firstly, the right installation positioning hole is moved rightwards to extend the distance of the separation zone. Meanwhile, the vibration mechanism is redesigned so that it as a whole moves toward the lower right of the material groove body. Therefore, there is enough space to install the separation screen in the separation zone. The tobacco scraps are separated out when they pass through the separation screen, thus reducing cone dropping when the cigarette burns, stabilizing the amount of tobacco dropping at the end. The method is applied to any device for reducing combustion cone fallout propensity and stabilizing loss of tobacco from cigarette ends as described above, wherein the method comprises the following steps:

step 1: defining a separation zone (1) moving the installation positioning hole rightwards under a condition that positions of the left installation positioning hole and the dropping tobacco holes of the raw material groove body remain unchanged, moving the right installation positioning hole rightwards and redefining the separation zone to extend a distance of the separation zone;

(2) providing the separation rectangular hole providing the separation rectangular hole having a width equal to a width of the material groove body at a left side of the right installation positioning hole;

(3) setting the guide positioning groove wherein the guide positioning groove comprises a baffle plate and two positioning plates having a width equal to a width of the material groove body and arranged in parallel, the baffle plate and the two positioning plates are vertically arranged, a cross section of each positioning plate is in a convex shape, the guide positioning groove is embedded in the separation rectangular hole, an outer side of a raised platform of each positioning plate is fixed by fitting with the separation rectangular hole, an upper end surface of the raised platform is in the same plane as an inner bottom surface of the material groove body, a sinking platform inside each positioning plate is provided as a guide slide rail capable of being inserted into the separating screen, and the baffle plate is fixed by fitting with an outer side of the material groove body to limit a moving position of the separation screen;

step 2: installing the separation screen installing a separation screen to fit the guide positioning groove, wherein the separation screen is used for separating the tobacco scraps; and the separation screen comprises a screen mesh, a fixed plate, and a guide channel located below the screen mesh and used for a guide discharge function after tobacco scrap separation, two sides of the screen mesh is capable of being inserted in the guide slide rail of a positioning plate, and the fixed plate is fixed by fitting with an outer side of the material groove body;

step 3: improving the vibration mechanism removing an original vibration mechanism;

wherein an improved vibration mechanism comprises a positioning block, an elastic vibration plate, and a power mechanism, wherein the power mechanism drives the positioning block to move, the positioning block drives the material groove body for uninterrupted reciprocating movement under the support of the elastic vibration plate; the positioning block is fixedly connected with the material groove body through the right installation positioning hole, an upper end of the elastic vibration plate is installed in a side surface of a lower part of the positioning block toward a side of the feeding end, a lower end of the elastic vibration plate is installed in an upper part of the power mechanism, so that the vibration mechanism shifts toward lower right, so as to provide a maximum installation space for the separation screen without affecting movement effect of the material groove body; and step 4: determining a motion parameter of the material groove body, and determining whether a motion state of the material groove body meets working requirements through a force analysis of the tobacco.

As an improvement to the above solution, step 4 comprises:

Step 41, determining a vibration parameter:

(1) selecting an amplitude A=5 mm;

(3) selecting a mechanical index K=4;

(3) when A=5 mm and K=4, determining that a vibration excitation frequency f=14 Hz;

(4) when K=4, selecting a vibration direction angle $\delta=45°$;

(5) selecting a throwing index $1<D<3.3$, so that conveyed materials are sliding in a micro parabolic state;

Step 42, analyzing the motion of tobacco in the material groove body determining the vibration direction angle $\delta=45°$;

determining the material throwing index D: according to $D=K \sin \delta$, $D=4 \sin 45°$. $D=2.83$;

wherein the motion state of the materials relative to the material groove body is mainly throwing motion state, so as to reduce resistance of the material motion and reduce wear of the materials on the material groove body.

The present invention has the following beneficial effects:

In the present application, an original excess tobacco recycling material groove is improved, so that the fine tobacco scraps that do not meet the requirements of a filling process are separated out during a process of excess tobacco recycling, and the tobacco in line with the requirements of the filling process is transmitted to the material storage area for the excess tobacco recycling.

Firstly, the right installation positioning hole is moved rightwards to extend the distance of the separation zone. Meanwhile, the vibration mechanism is redesigned so that it as a whole moves toward the lower right of the material groove body. Therefore, there is enough space to install the separation screen in the separation zone. The tobacco scraps are separated out when they pass through the separation screen, thus reducing cone dropping when the cigarette burns, stabilizing the amount of dropping tobacco at the end, and improving the smoking experience and recognition of customers with regard to cigarette products.

BRIEF DESCRIPTION OF THE DRAWINGS

The present invention is further explained in combination with drawings and specific embodiments.

Figure 1:
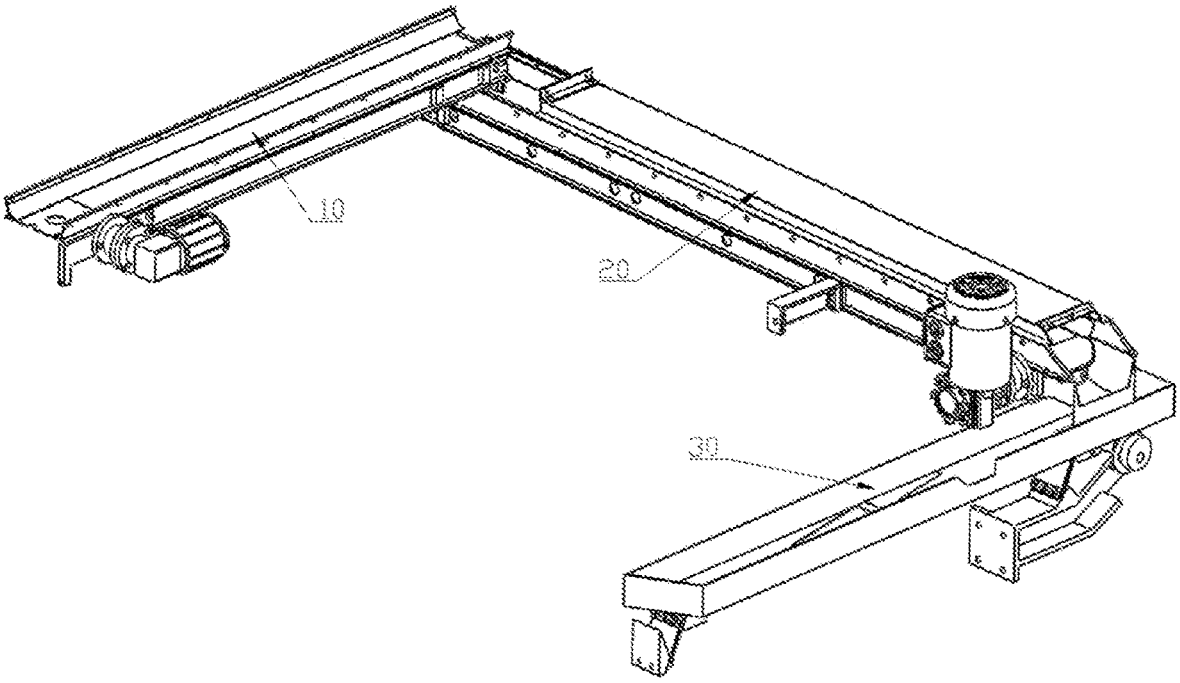
FIG. 1 is a structural schematic diagram of an excess tobacco recycling system of an original feeding and sliver forming machine.
Figure 2:
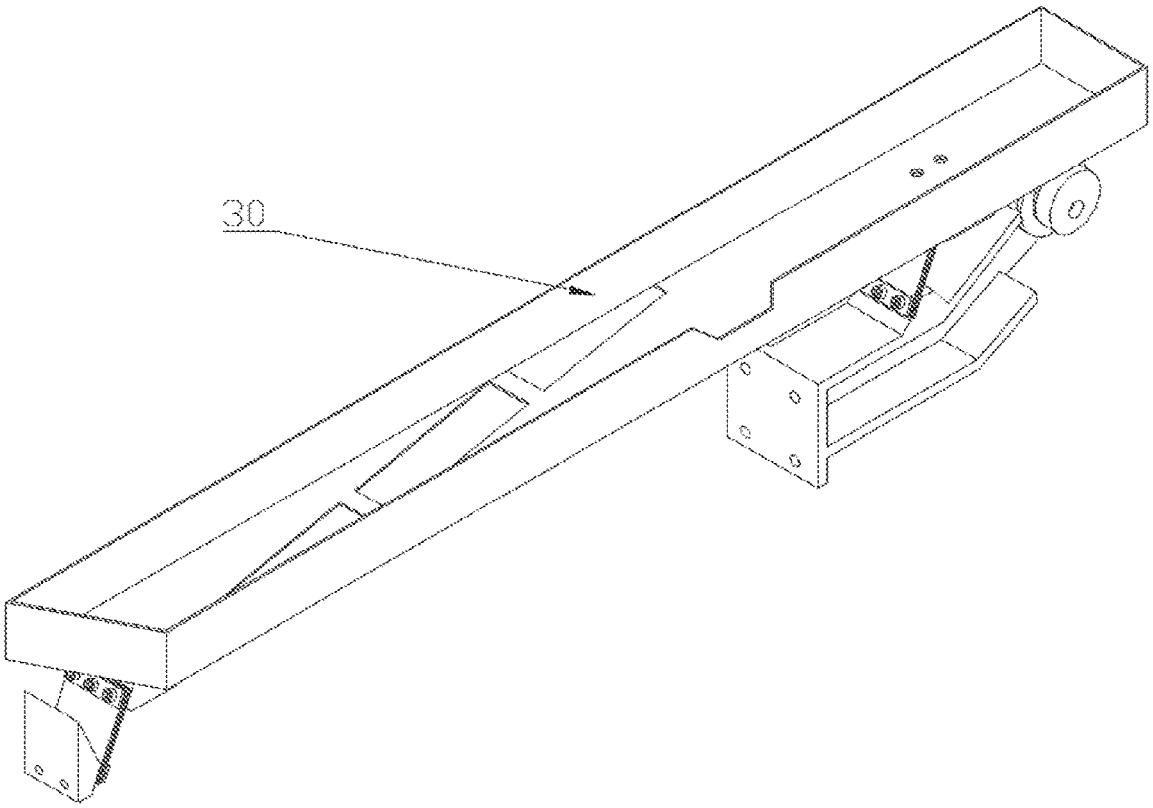
FIG. 2 is a structural schematic diagram of an original excess tobacco recycling material groove device.
Figure 3:
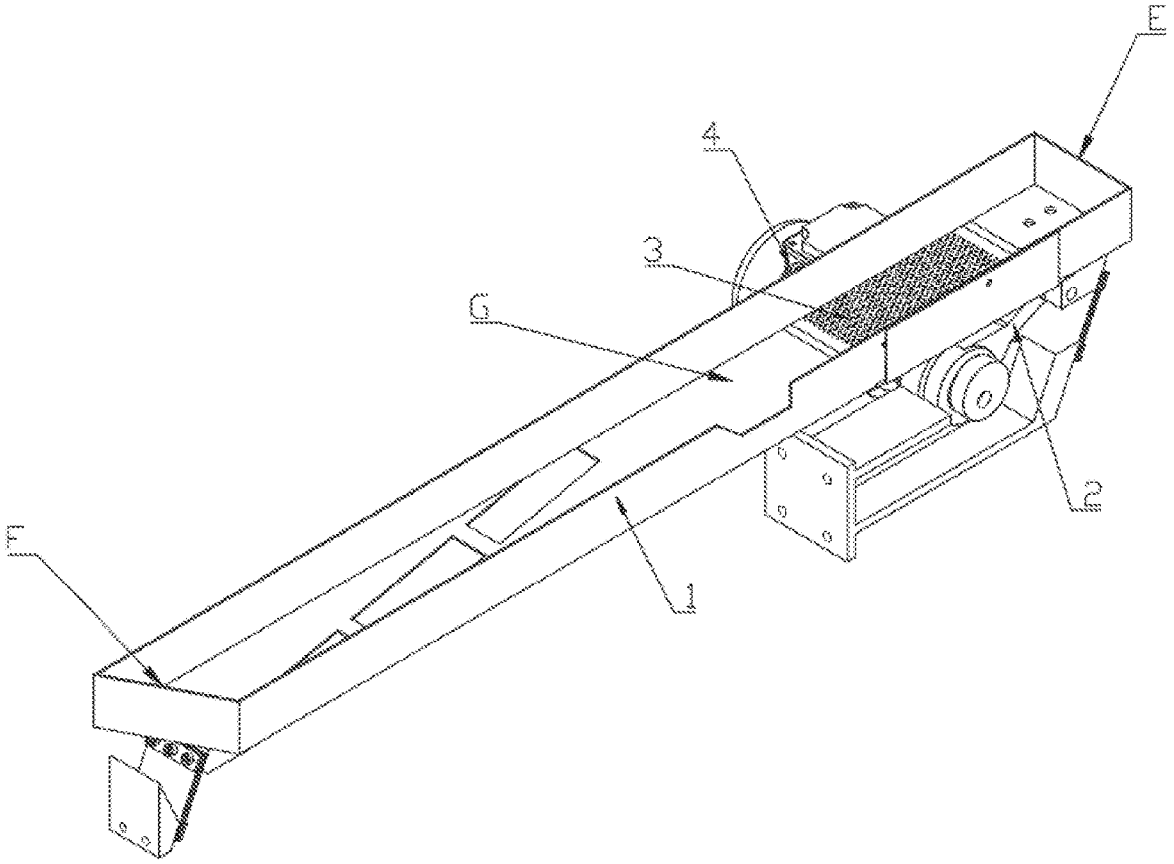
FIG. 3 is a structural schematic diagram of an excess tobacco recycling material groove device of a feeding and sliver forming machine of the present application.
Figure 4:
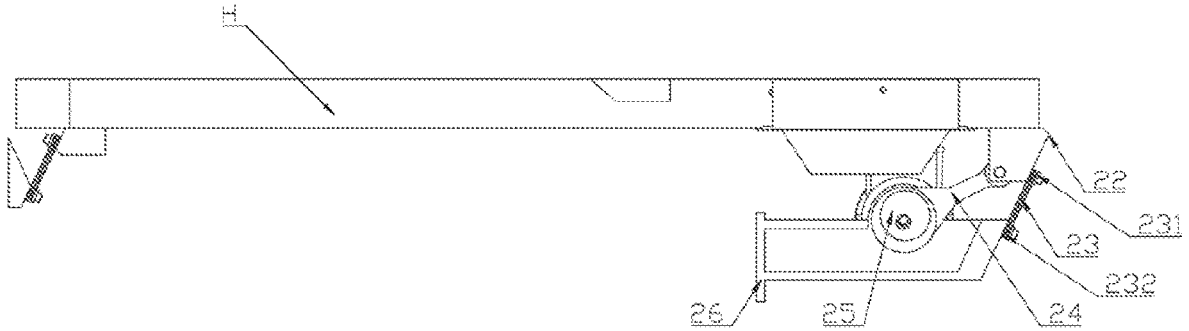
FIG. 4 is a front view of the excess tobacco recycling material groove device of the feeding and sliver forming machine of the present application.
Figure 5:
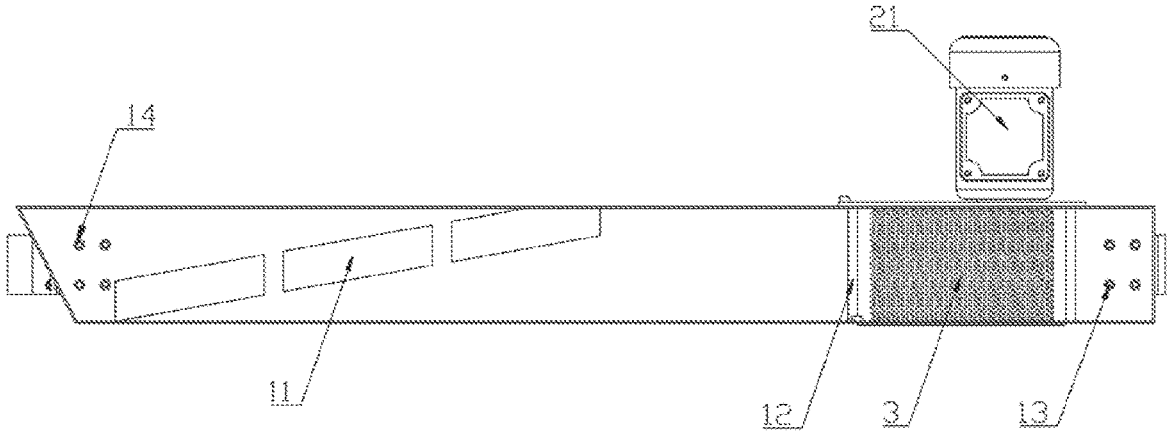
FIG. 5 is a top view of the excess tobacco recycling material groove device of the feeding and sliver forming machine of the present application.
Figure 6:
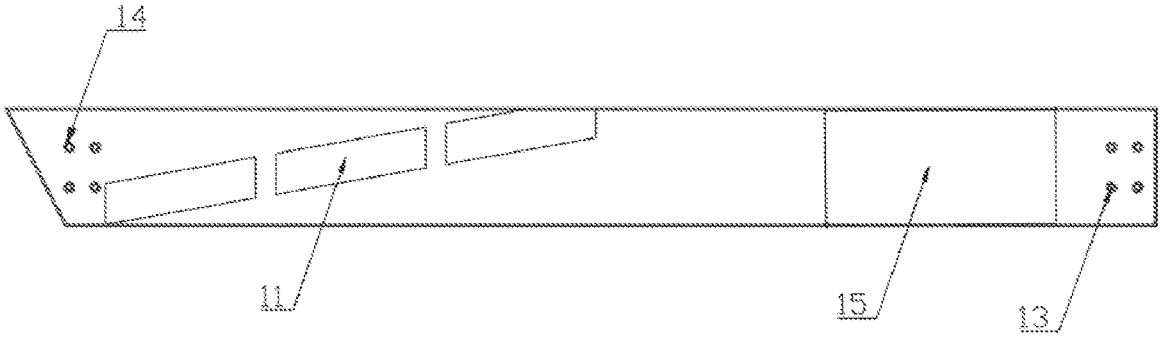
FIG. 6 is a top view of the material groove body of the present application

In the figures, 10. secondary tobacco recycling device; 20. primary tobacco recycling device; 30. tobacco recycling material groove; 1. material groove body; E. feeding end; F. discharging end; G. bottom surface of the material groove body; H. outer side of the material groove body; 11. dropping tobacco hole; 12. guide positioning groove; 121. positioning plate; 1211. raised platform; J. upper end surface of the raised platform; L. cross section of the positioning plate; 1212. sinking platform; 122. baffle plate; 13. right installation positioning hole; 14. left installation positioning hole; 15. separation rectangular hole; 2. vibration mechanism; 21. motor; 211. output shaft; 22. positioning block; 23. elastic vibration plate; 231. upper end of the elastic vibration plate; 232. lower end of the elastic vibration plate; 24. connecting rod; 241. big head of the connecting rod; 242. small head of the connecting rod; 25. eccentric disk; 26. transmission bracket; 3. separation screen.

DESCRIPTION OF THE EMBODIMENTS

In the following, the technical solution in embodiments of the present invention is clearly and completely described in combination with drawings in the embodiments of the present invention. Obviously, the described embodiments are only a part of the embodiments of the present invention, but not all the embodiments. Based on the embodiments of the present invention, all other embodiments obtained by an ordinary person skilled in the art without creative labor are within the protection scope of the present invention.

In the description of the present invention, it needs to be understood that, an orientation or a location relationship indicated by a term such as "upside", "downside". "top end". "two ends", "width", "height", "up", "down", "before", "after", "left", "right", "vertical", "horizontal", "top", "bottom". "within" or "outside" is an orientation or a location relationship as shown in the figures. It is only to facilitate the description of the present invention and simplify the description, but not to indicate or imply that the device or element referred to must have a particular orientation, be constructed and operated in a particular orientation. Therefore, it cannot be construed as a limitation to the present invention.

In the present invention, unless otherwise expressly specified and qualified, the term such as "set", "install". "connected". "connect" or "communicated" shall be understood broadly. For example, it can be a fixed or detachable connection. It can be a mechanical connection. It can be directly connected or indirectly connected through an intermediate medium. For an ordinary person skilled in the art, the specific meanings of the above terms in the present invention can be understood according to the specific circumstances.

In the present application, firstly, the right installation positioning hole is moved rightwards to extend the distance of the separation zone. Meanwhile, the vibration mechanism is redesigned so that it as a whole moves toward the lower right of the material groove body. Therefore, there is enough space to install the separation screen in the separation zone. The tobacco scraps are separated out when they pass through the separation screen, thus reducing cone dropping when the cigarette burns, stabilizing the amount of dropping tobacco at the end, and improving the smoking experience and recognition of customers with regard to cigarette products.

The present application provides a method for reducing combustion cone dropping and stabilizing dropping tobacco at an end, wherein the method comprises the following steps:

step 1: defining a separation zone (1) moving the installation positioning hole rightwards under a condition that positions of the left installation positioning hole and the dropping tobacco holes 11 of the raw material groove body 1 remain unchanged, moving the right installation positioning hole 13 rightwards and redefining the separation zone to extend a distance of the separation zone.

(2) providing the separation rectangular hole providing the separation rectangular hole with an equal width to the material groove body 1 at a left side of the right installation positioning hole 13.

(3) setting the guide positioning groove 12

The guide positioning groove 12 comprises a baffle plate and two positioning plates having a width equal to a width of the material groove body 1 and arranged in parallel, the baffle plate and the two positioning plates are vertically arranged, a cross section of each positioning plate is in a convex shape, the guide positioning groove 12 is embedded in the separation rectangular hole, an outer side of a raised platform of each positioning plate is fixed by fitting with the separation rectangular hole, an upper end surface of the raised platform is in the same plane as an inner bottom surface of the material groove body 1, a sinking platform inside each positioning plate is provided as a guide slide rail that is capable of being inserted into the separating screen 3, and the baffle plate is fixed by fitting with an outer side of the material groove body 1 to limit a moving position of the separation screen 3.

step 2: installing the separation screen 3

Installing a separation screen 3 to fit with the guide positioning groove 12 in a fitting manner, wherein the separation screen is used for separating the tobacco scraps.

The separation screen 3 comprises a screen mesh, a fixed plate and a guide channel located below the screen mesh and used for a guide discharge function after tobacco scrap separation, two sides of the screen mesh is capable of being inserted in the guide slide rail of a positioning plate, and the fixed plate is fixed by fitting with an outer side of the material groove body 1.

step 3: improving the vibration mechanism 2 removing an original vibration mechanism 2.

An improved vibration mechanism 2 comprises a positioning block 22, an elastic vibration plate 23 and a power mechanism, wherein the power mechanism drives the positioning block 22 to move, the positioning block 22 drives the material groove body 1 for uninterrupted reciprocating movement under the support of the elastic vibration plate 23; the positioning block 22 is fixedly connected with the material groove body 1 through the right installation positioning hole 13, an upper end of the elastic vibration plate 23 is installed in a side surface of a lower part of the positioning block 22 toward a side of the feeding end, a lower end of the elastic vibration plate is installed in an upper part of the power mechanism, so that the vibration mechanism 2 shifts toward lower right, so as to provide a maximum installation space for the separation screen 3 without affecting movement effect of the material groove body 1.

step 4: determining a motion parameter of the material groove body 1, and determining whether a motion state of the material groove body 1 meets working requirements through a force analysis of the tobacco.

The method is applied to the device for reducing combustion cone dropping and stabilizing dropping tobacco at an end.

The device comprises:

a material groove body 1 of which a feeding end E is higher than a discharging end F, wherein a bottom surface G of the material groove body is provided, from left to right, with a left installation positioning hole 14 in a left end, a plurality of dropping tobacco holes 11, and a separation rectangular hole 15 having an equal width to the material groove body 1 and a right installation positioning hole 13; the right installation positioning hole 13 is moved rightwards to a right end of the material groove body 1 to extend a separation distance of tobacco scraps; and the material groove body 1 comprises a guide positioning groove 12 matched with the separation rectangular hole 15' a separation screen 3 detachably installed to fit the guide positioning groove, wherein the separation screen is used for separating the tobacco scraps; and a vibration mechanism 2, installed below the feeding end E through the right installation positioning hole 13, wherein the vibration mechanism 2 comprises a positioning block 22, an elastic vibration plate 23, and a power mechanism 4, wherein the power mechanism 4 drives the positioning block 22 to move, the positioning block 22 drives the material groove body 1 for uninterrupted reciprocating movement under the support of the elastic vibration plate 23; the positioning block 22 is fixedly connected with the material groove body 1 through the right installation positioning hole 13, an upper end 231 of the elastic vibration plate 23 is installed in a side surface of a lower part of the positioning block 22 toward a side of the feeding end, a lower end 232 of the elastic vibration plate 23 is installed in an upper part of the power mechanism 4, so that the vibration mechanism shifts toward lower right, so as to provide a maximum installation space for the separation screen 3 without affecting movement effect of the material groove body.

Embodiment 1

Refer to FIG. 3 to FIG. 6, a device for reducing combustion cone dropping and stabilizing dropping tobacco at an end, wherein the device comprises: a material groove body 1, a separation screen 3 and a vibration mechanism 2.

For the material groove body 1, the total length (the distance from the feeding end E to the discharging end F) of the bottom surface G of the material groove body 1 thereof is 1200 mm, and the width (the distance perpendicular to the length) is 118 mm. A feeding end of the material groove body 1 is higher than a discharging end, wherein a bottom surface of the material groove body is provided, from left to right, with a left installation positioning hole in a left end, three dropping tobacco holes 11, and a separation rectangular hole having an equal width to the material groove body 1 and a right installation positioning hole 13. The dropping tobacco is dropped into a material storage area located below it through 3 dropping tobacco holes 11. The right installation positioning hole 13 is moved rightwards for 150 mm to lengthen a separation distance of tobacco scraps. The separation rectangular hole is arranged at 80 mm to a right end surface of the material groove body 1, with a length of 230 mm and a width of 118 mm. The material groove body 1 comprises a guide positioning groove 12 matched with the separation rectangular hole.

For the separation screen 3, it is detachably installed to fit the guide positioning groove 12, wherein the separation screen is used for separating the tobacco scraps.

For the vibration mechanism 2, it is installed below the feeding end through the right installation positioning hole 13, the vibration mechanism 2 comprises a positioning block 22, an elastic vibration plate 23 and a power mechanism, wherein the power mechanism drives the positioning block 22 to move, the positioning block 22 drives the material groove body 1 for uninterrupted reciprocating movement under the support of the elastic vibration plate 23; the positioning block 22 is fixedly connected with the material groove body 1 through the right installation positioning hole 13; a side surface of a lower part of the positioning block 22 toward a side of the feeding end is provided with a threaded hole; an upper end of the elastic vibration plate 23 is fixedly installed in the positioning block 22 through the threaded hole; a lower end of the elastic vibration plate is installed in an upper part of the power mechanism, so that the vibration mechanism 2 shifts toward lower right, so as to provide a maximum installation space for the separation screen 3 without affecting movement effect of the material groove body 1.

Figure 7:
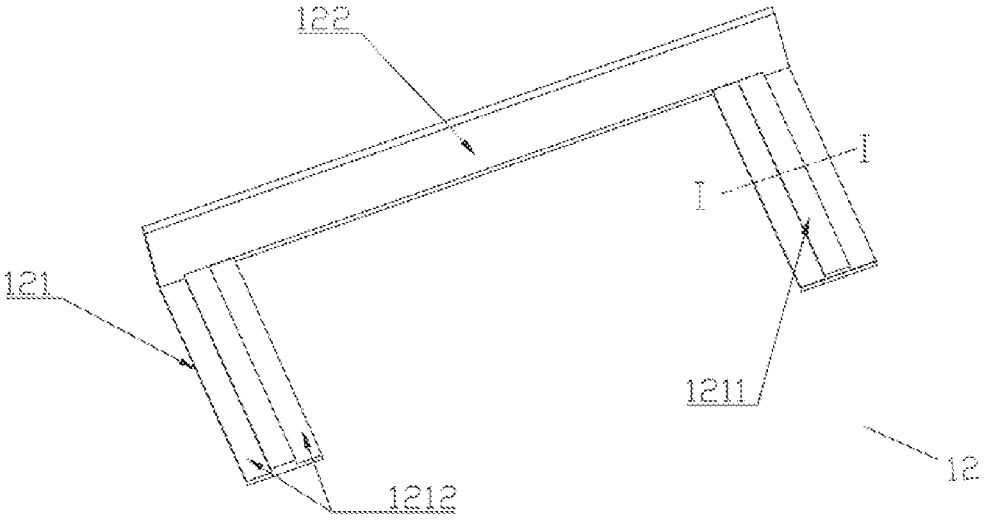
FIG. 7 is a structural schematic diagram of the guide positioning groove in the present application.
Figure 8:
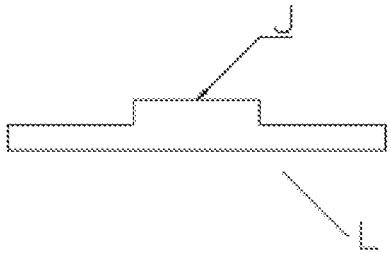
FIG. 8 is a section view of the positioning plate along the direction I-I of FIG. 7 in the present application.

Refer to FIGS. 7 and 8, the width of the guide positioning groove 12 is 118 mm. The guide positioning groove comprises a baffle plate 122 and two positioning plates 121 arranged in parallel, and the baffle plate is arranged vertically with the two positioning plates. A cross section L of each positioning plate 121 is in a convex shape, the guide positioning groove 12 is embedded in the separation rectangular hole. Two outer end surfaces of raised platforms 1211 of the positioning plates 121 are fixed by fitting with the separate rectangular hole. An upper end surface 1 of the raised platform is in the same plane as an inner bottom surface of the material groove body 1, a sinking platform 1212 inside each positioning plate is provided as a guide slide rail that is capable of being inserted into the separating screen 3, and the baffle plate is fixed by fitting with an outer side of the material groove body 1 to limit a moving position of the separation screen 3.

Figure 9:
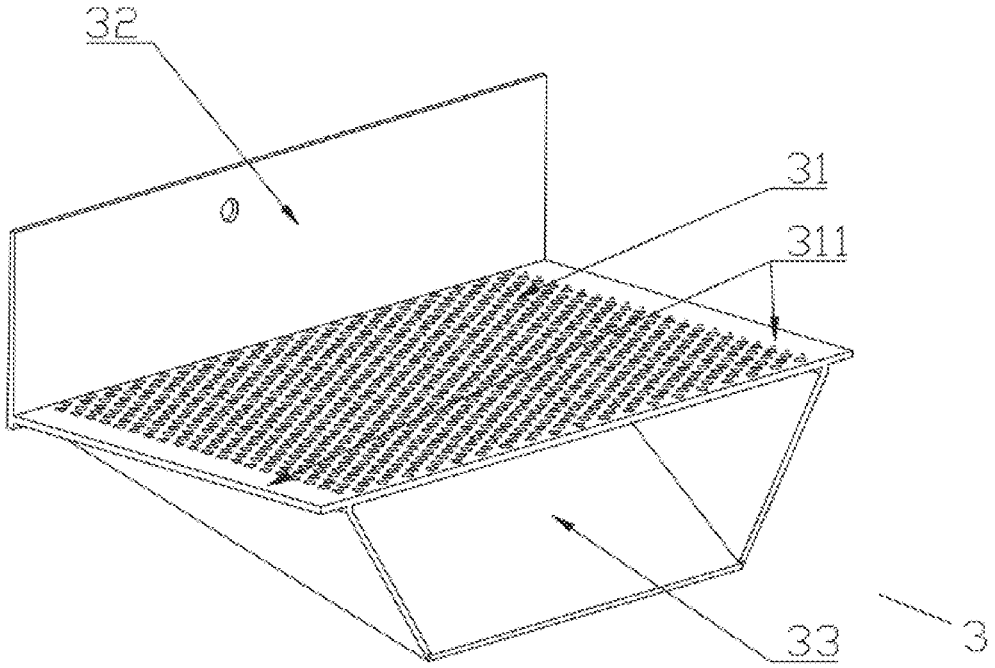
FIG. 9 is a structural schematic diagram of the separation screen in the present application.
Figure 10:
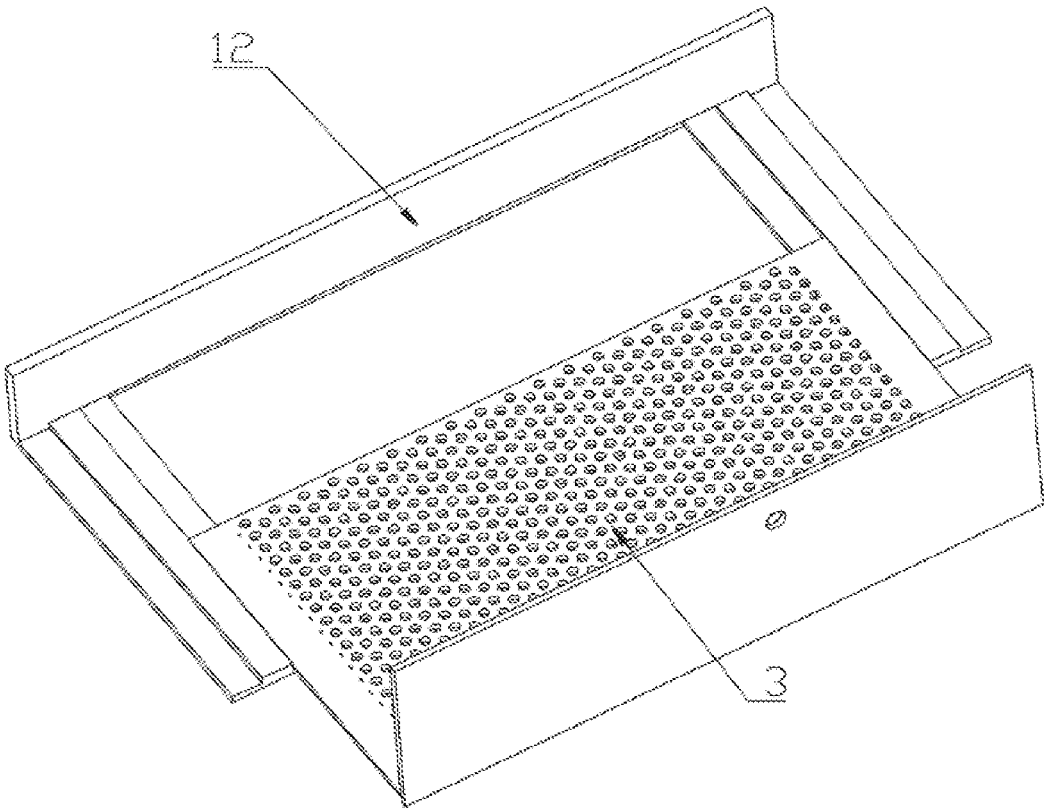
FIG. 10 is an assembly diagram of the guide positioning groove and the separation screen in the present application.

Refer to FIG. 9 and FIG. 10, the separation screen 3 comprises a screen mesh 31, a fixed plate 32 and a guide channel 33 located below the screen mesh and used for a guide discharge function after tobacco scrap separation, two sides 311 of the screen mesh is capable of being inserted in the guide slide rail of a positioning plate 121, and the fixed plate is fixed by fitting with an outer side of the material groove body 1 through a bolt.

The separation screen 3 comprises a plurality of mesh distribution and mesh number specifications to select an appropriate separation screen 3 for separating tobacco scraps according to tobacco structures of high, medium and low grade cigarettes.

Figure 11:
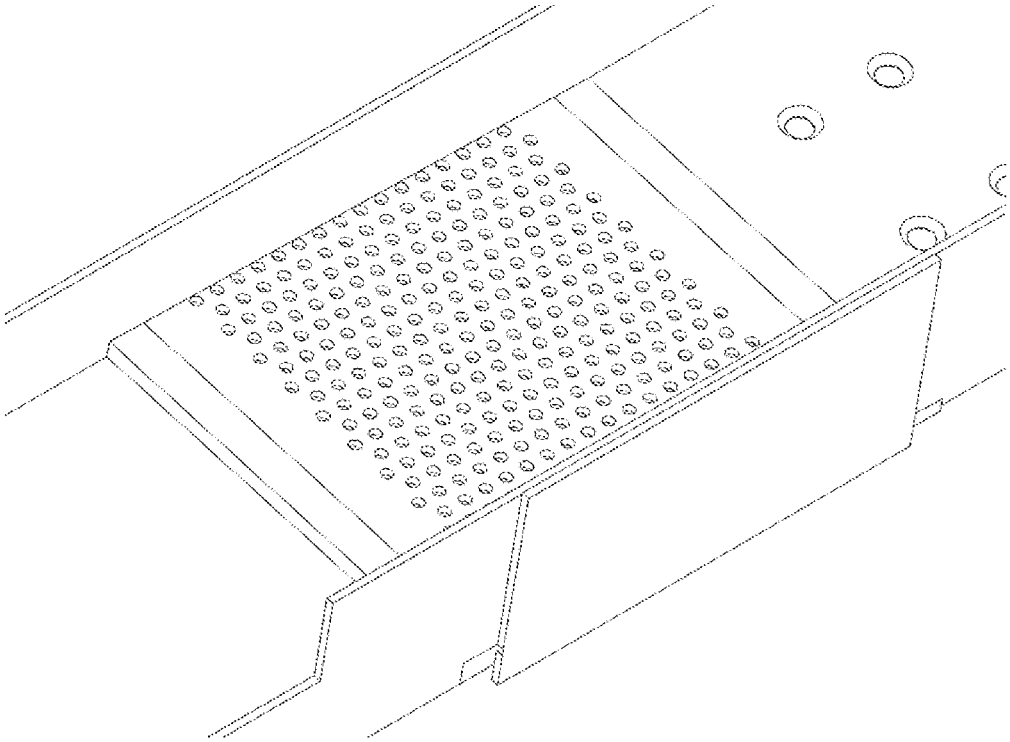
FIG. 11 is a partial enlarged diagram of the material groove body with an inclined screen mesh installed in the present application.
Figure 12:
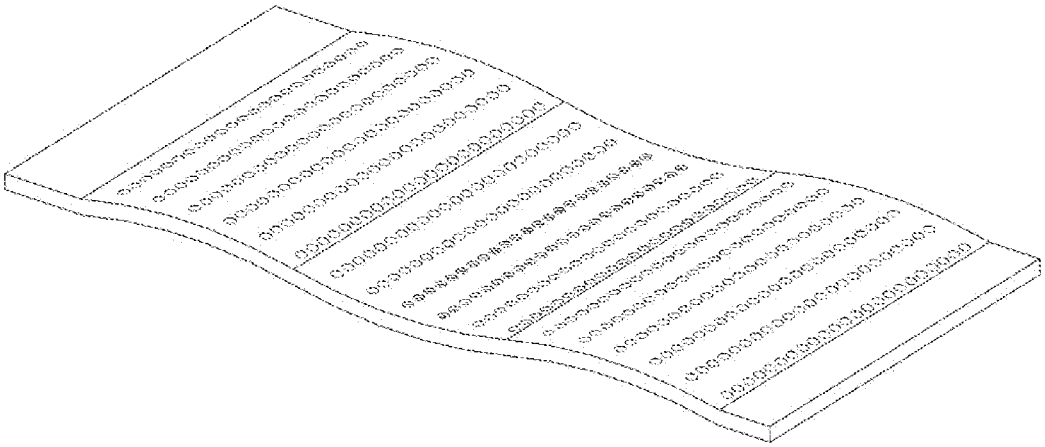
FIG. 12 is a structural schematic diagram of the screen mesh with a wavy surface of the present application.

Refer to FIG. 11, the separation screen 3 may be provided with an inclined surface having an upper end surface facing a side of the discharging end. Refer to FIG. 12, the separation screen 3 may also be provided with a wavy surface from top to bottom. The two types of surfaces are used to change a movement pattern for conveying recycled excess tobacco and to make broken tobacco located in an upper layer be fully separated by wave motion in vibration in the process of excess tobacco recycling.

Figure 13:
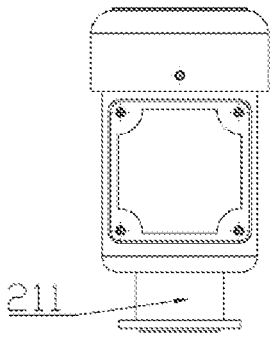
FIG. 13 is a structural schematic diagram of the motor of the present application.
Figure 14:
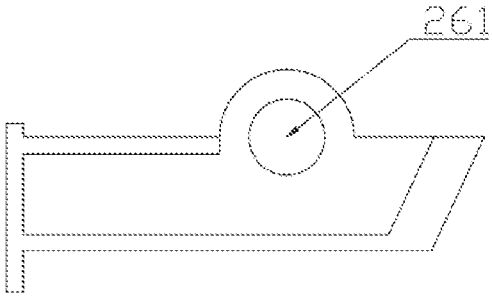
FIG. 14 is a structural schematic diagram of the transmission bracket of the present application.
Figure 15:
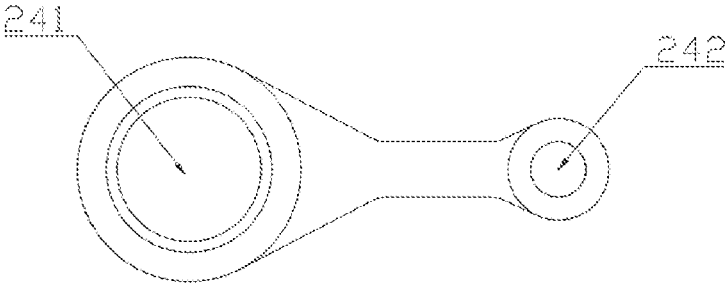
FIG. 15 is a structural schematic diagram of the connecting rod of the present application.

The power mechanism comprises a motor 21, a transmission bracket 26, an eccentric disk 25 and a connecting rod 24, wherein a lower end of the elastic vibration plate 23 is installed in an upper part of the transmission bracket 26, so as to provide sufficient installation space for the separation screen 3 to a maximum extent without affecting a movement effect of the material groove body 1. Refer to FIGS. 13-15, the transmission bracket 26 is provided with a center hole for installing the motor 21; an output shaft of the motor 21 is rotatably connected with the eccentric disk 25 through a bearing; the eccentric disk 25 is rotatably connected with a big head of the connecting rod 24; a small head of the connecting rod 24 is connected with the positioning block 22; and when the motor 21 rotates, the eccentric disk 25 drives the connecting rod 24 to move, the connecting rod 24 drives the positioning block 22 to move, and the positioning block 22 drives the material groove body 1 to make the uninterrupted reciprocating movement under the support of the elastic vibration plate 23.

Figure 16:
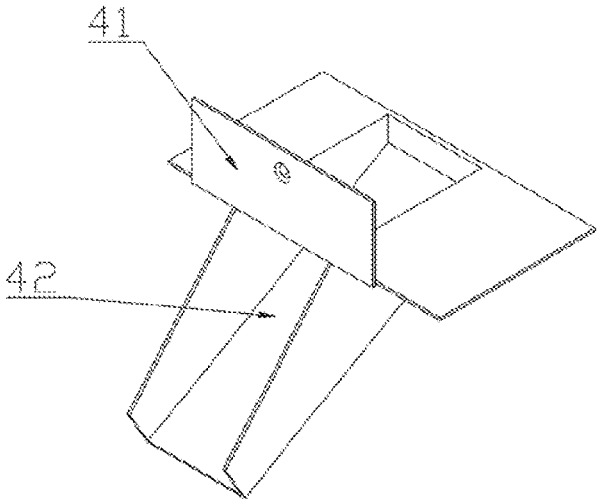
FIG. 16 is a structural schematic diagram of a stem-taken box in the present application.

Refer to FIG. 16, the separation screen is replaced by a stem-taken box for exporting materials; the stem-taken box comprises a fixed lateral plate 41 and a guide channel 42 communicated with the material groove body; and the fixed plate is fixed by fitting with an outer side of the material groove body. The stem-taken box takes out the recycled excess tobacco within a specified time and weighs it to determine a best amount of the recycled excess tobacco, a manual process of taking out the recycled excess tobacco is eliminated, which is convenient and fast.

Embodiment 2

Provided in the present embodiment is a method for reducing combustion cone dropping and stabilizing dropping tobacco at an end, wherein the method is applied to the device for reducing combustion cone dropping and stabilizing dropping tobacco at an end as described in embodiment 1, wherein the method comprises the following steps:

step 1: defining a separation zone (1) moving the installation positioning hole rightwards under a condition that positions of the left installation positioning hole and the dropping tobacco holes 11 of the raw material groove body 1 remain unchanged, moving the right installation positioning hole 13 rightwards and redefining the separation zone to extend a distance of the separation zone.

(2) providing the separation rectangular hole providing the separation rectangular hole with an equal width to the material groove body 1 at a left side of the right installation positioning hole 13.

(3) setting the guide positioning groove 12

The guide positioning groove 12 comprises a baffle plate and two positioning plates having a width equal to a width of the material groove body 1 and arranged in parallel, the baffle plate and the two positioning plates are vertically arranged, a cross section of each positioning plate is in a convex shape, the guide positioning groove 12 is embedded in the separation rectangular hole, an outer side of a raised platform of each positioning plate is fixed by fitting with the separation rectangular hole, an upper end surface of the raised platform is in the same plane as an inner bottom surface of the material groove body 1, a sinking platform inside each positioning plate is provided as a guide slide rail that is capable of being inserted into the separating screen 3, and the baffle plate is fixed by fitting with an outer side of the material groove body 1 to limit a moving position of the separation screen 3.

step 2: installing the separation screen 3

Installing a separation screen 3 to fit with the guide positioning groove 12 in a fitting manner, wherein the separation screen is used for separating the tobacco scraps.

The separation screen 3 comprises a screen mesh, a fixed plate and a guide channel located below the screen mesh and used for a guide discharge function after tobacco scrap separation, two sides of the screen mesh is capable of being inserted in the guide slide rail of a positioning plate, and the fixed plate is fixed by fitting with an outer side of the material groove body 1.

step 3: improving the vibration mechanism 2 removing an original vibration mechanism 2.

An improved vibration mechanism 2 comprises a positioning block 22, an elastic vibration plate 23 and a power mechanism, wherein the power mechanism drives the positioning block 22 to move, the positioning block 22 drives the material groove body 1 for uninterrupted reciprocating movement under the support of the elastic vibration plate 23; the positioning block 22 is fixedly connected with the material groove body 1 through the right installation positioning hole 13, an upper end of the elastic vibration plate 23 is installed in a side surface of a lower part of the positioning block 22 toward a side of the feeding end, a lower end of the elastic vibration plate is installed in an upper part of the power mechanism, so that the vibration mechanism 2 shifts toward lower right, so as to provide a maximum installation space for the separation screen 3 without affecting movement effect of the material groove body 1.

step 4: determining a motion parameter of the material groove body 1, and determining whether a motion state of the material groove body 1 meets working requirements through a force analysis of the tobacco.

Step 4 comprises:

step41, determining a vibration parameter:

(1) selecting an amplitude A

A value range of A varies with different vibration excitation mechanisms. Usually, for an inertial drive mechanism (eccentric block vibration exciter), a medium frequency and a medium amplitude should be adopted, that is, A=0.5-6 mm, and A=5 mm should be selected.

(2) selecting a mechanical index

The mechanical index is a ratio of a maximum acceleration Xmax of the motion of the material groove body 1 to the acceleration g of gravity, namely:

$$K = 4\pi^2 f^2 A/g$$

In the formula, $w=2\pi f$. In order to ensure reliable operation of the equipment and prolong its service life. K=3~5 and mechanical index K=4 are selected for a commonly used inertial vibration equipment.

(3) determining a vibration excitation frequency

When the mechanical index K and amplitude A are determined, the vibration excitation frequency can be obtained from $f=(gk/4\pi^2A)^{0.5}$ (The value range: f=10~25 Hz, equivalent to 600-1500 times/min). As K=4, and A=5 mm, f=14 Hz is obtained.

(4) determining a vibration direction angle

The vibration direction angle depends on the use of equipment and properties of materials. In order to improve a conveying speed, an optimal vibration direction angle corresponds to the mechanical index: $\delta$=30-60° when K=4, and $\delta$=45° is selected.

(5) selecting a throwing index D

The throwing index is a ratio of a vertical component of a maximum acceleration of the material groove body 1 to the acceleration g of gravity, namely:

$$D = A\omega^2 \sin \sigma / g \cos \alpha$$

In the formula, $\alpha$ is an inclination angle of the vibration equipment. Generally, $1<D<3.3$ is selected, so that conveyed materials are sliding in a micro parabolic state.

Step 42, analyzing the motion of tobacco in the material groove body 1

Figure 17:
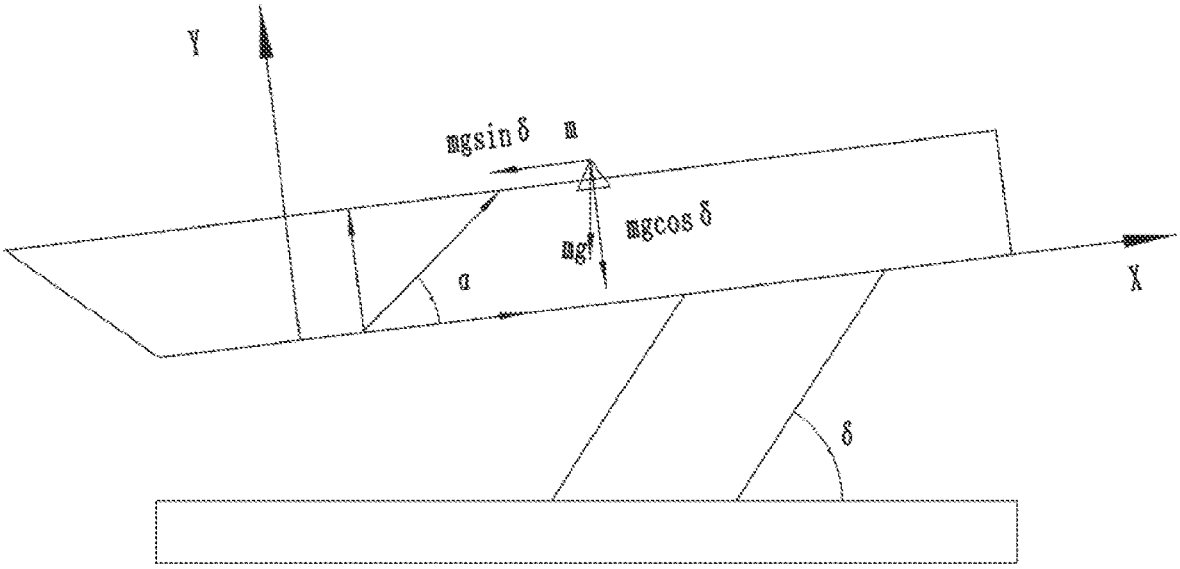
FIG. 17 is a stress analysis diagram of materials in the material groove body and the material groove body of the present application.

Refer to FIG. 17 for a stress condition of materials in the material groove body 1 and the material groove body 1.

Determining the vibration direction angle δ: 45 degrees is selected;

Determining the material throwing index D: according to D=K sin δ, D=4 sin 45°, D=2.83;

A simple harmonic motion of the material groove body 1 is s=Asinwt. It can be obtained from a dynamic balance equation that: N=mg cos α-ms sin δ;

The tobacco is thrown away from a working surface in the conveying process, then an instantaneous positive pressure N=O.

$$D = A\omega^2 \sin \delta / g \cos \alpha$$

In the above formula, D=2.83, A=0.005 m, S=45°, $$\omega = \sqrt{Kg/A}.$$

It can be obtained that α=0°, that is, the material groove body 1 is set horizontally.

When D<1, the materials are stationary or only sliding relative to the material groove body 1. When D>1, the motion state of the materials relative to the material groove body 1 is mainly throwing motion state, so as to reduce resistance of the material motion and reduce wear of the materials on the material groove body 1. However, the throwing motion is too intense and easy to break the materials or make the conveying state unstable. Generally, 1<D<3.3, so the calculated D=2.83 meets the working requirements.

It should be explained that: the above mentioned embodiments are only preferred embodiments of the present invention, and are not used to limit the present invention; although the present invention is described in detail with reference to the aforementioned embodiments, a person skilled in the art may modify the technical solution recorded in the aforementioned embodiments, or make equivalent substitutions of part of technical features thereof; and within the spirit and principles of the present invention, any modification, equivalent replacement, improvement and so on made shall be included in the protection scope of the present invention.

The invention claimed is:

1. A method for reducing combustion cone fallout propensity and stabilizing loss of tobacco from cigarette ends by a device for reducing combustion cone fallout propensity and stabilizing loss of tobacco from cigarette ends, wherein the device comprises:

a material groove body of which a feeding end is higher than a discharging end, wherein a bottom surface of the material groove body is provided, from left to right, with a left installation positioning hole in a left end, a plurality of dropping tobacco holes, and a separation rectangular hole having an equal width to the material groove body and a right installation positioning hole; the right installation positioning hole is moved rightwards to a right end of the material groove body to extend a separation distance of tobacco scraps; and the material groove body comprises a guide positioning groove matched with the separation rectangular hole;

a separation screen detachably installed to fit the guide positioning groove, wherein the separation screen is used for separating the tobacco scraps; and a vibration mechanism, installed below the feeding end through the right installation positioning hole, wherein the vibration mechanism comprises a positioning block, an elastic vibration plate, and a power mechanism, wherein the power mechanism drives the positioning block to move, the positioning block drives the material groove body for uninterrupted reciprocating movement under the support of the elastic vibration plate; the positioning block is fixedly connected with the material groove body through the right installation positioning hole, an upper end of the elastic vibration plate is installed in a side surface of a lower part of the positioning block toward a side of the feeding end, a lower end of the elastic vibration plate is installed in an upper part of the power mechanism, so that the vibration mechanism shifts toward lower right, so as to provide a maximum installation space for the separation screen without affecting movement effect of the material groove body;

and the method comprises the following steps:

step 1: defining a separation zone (1) moving the installation positioning hole rightwards under a condition that positions of the left installation positioning hole and the dropping tobacco holes of the raw material groove body remain unchanged, moving the right installation positioning hole rightwards to define the separation zone to extend a distance of the separation zone;

(2) providing the separation rectangular hole providing the separation rectangular hole having a width equal to a width of the material groove body at a left side of the right installation positioning hole;

(3) setting the guide positioning groove wherein the guide positioning groove comprises a baffle plate and two positioning plates having a width equal to a width of the material groove body and arranged in parallel, the baffle plate and the two positioning plates are vertically arranged, a cross section of each positioning plate is in a convex shape, the guide positioning groove is embedded in the separation rectangular hole, an outer side of a raised platform of each positioning plate is fixed by fitting with the separation rectangular hole, an upper end surface of the raised platform is in the same plane as an inner bottom surface of the material groove body, a sinking platform inside each positioning plate is provided as a guide slide rail capable of being inserted into the separating screen, and the baffle plate is fixed by fitting with an outer side of the material groove body to limit a moving position of the separation screen;

step 2: installing the separation screen installing a separation screen to fit the guide positioning groove, wherein the separation screen is used for separating the tobacco scraps; and the separation screen comprises a screen mesh, a fixed plate, and a guide channel located below the screen mesh and used for a guide discharge function after tobacco scrap separation, two sides of the screen mesh is capable of being inserted in the guide slide rail of a positioning plate, and the fixed plate is fixed by fitting with an outer side of the material groove body;

step 3, installing the vibration mechanism wherein the vibration mechanism comprises a positioning block, an elastic vibration plate, and a power mechanism, wherein the power mechanism drives the positioning block to move, the positioning block drives the material groove body for uninterrupted reciprocating movement under the support of the elastic vibration plate; the positioning block is fixedly connected with the material groove body through the right installation positioning hole, an upper end of the elastic vibration plate is installed in a side surface of a lower part of the positioning block toward a side of the feeding end, a lower end of the elastic vibration plate is installed in an upper part of the power mechanism, so that the vibration mechanism shifts toward lower right, so as to provide a maximum installation space for the separation screen without affecting movement effect of the material groove body; and step 4: determining a motion parameter of the material groove body, and determining whether a motion state of the material groove body meets working requirements through a force analysis of the tobacco.

2. The method according to claim 1, wherein the separation screen comprises a plurality of mesh distribution and mesh number specifications to select an appropriate separation screen for separating tobacco scraps according to tobacco structures of high, medium and low grade cigarettes.

3. The method according to claim 1, wherein the separation screen is provided with an inclined surface having an upper end surface facing a side of the discharging end or a wavy surface from top to bottom, so as to change a movement pattern for conveying recycled excess tobacco and to make broken tobacco located in an upper layer be fully separated by wave motion in vibration in the process of excess tobacco recycling.

4. The method according to claim 1, wherein the separation screen is replaced by a stem-taken box for exporting materials; the stem-taken box comprises a fixed plate and a guide channel communicated with the material groove body; and the fixed plate is fixed by fitting with an outer side of the material groove body.

5. The method according to claim 1, wherein step 4 comprises:

step41, determining a vibration parameter:

(1) selecting an amplitude A=5 mm;

(2) selecting a mechanical index K=4;

(3) when A=5 mm and K=4, selecting a vibration excitation frequency f=14 Hz;

(4) when K=4, selecting a vibration direction angle $\delta=45°$;

(5) selecting a throwing index $1<D<3.3$, so that conveyed materials are sliding in a micro parabolic state;

step42, analyzing the motion of tobacco in the material groove body determining the material throwing index D: according to $D=K \sin \delta$, $D=4 \sin 45°$, $D=2.83$, wherein the motion state of the materials relative to the material groove body is mainly throwing motion state, so as to reduce resistance of the material motion and reduce wear of the materials on the material groove body.

* * * * *